US005375669A

United States Patent [19]

Cherrington

[11] Patent Number: 5,375,669

[45] Date of Patent: Dec. 27, 1994

[54] METHOD AND APPARATUS FOR CLEANING A BOREHOLE

[75] Inventor: Martin D. Cherrington, Fair Oaks, Calif.

[73] Assignee: Cherrington Corporation, Sacramento, Calif.

[21] Appl. No.: 17,642

[22] Filed: Feb. 12, 1993

[51] Int. Cl.[5] ..... E21B 7/28

[52] U.S. Cl. ..... 175/53; 175/62; 175/69; 175/102; 175/215; 175/324

[58] Field of Search ..... 175/53, 69, 71, 324, 175/215, 62, 102; 299/17; 166/312

[56] References Cited

U.S. PATENT DOCUMENTS

| | | | |
|---|---|---|---|
| 1,484,601 | 2/1924 | Carmichael | 166/312 |
| 2,537,605 | 1/1951 | Sewell | 175/324 X |
| 3,030,086 | 4/1962 | Donaldson et al. | 299/17 X |
| 3,393,013 | 7/1968 | Hammer et al. | 299/17 |
| 3,439,953 | 4/1969 | Pfefferle | 299/17 |
| 3,605,913 | 9/1971 | Lehtinen | 175/215 X |
| 4,043,136 | 8/1977 | Cherrington | 175/215 X |
| 4,134,619 | 1/1979 | Bunnelle | 175/215 X |
| 4,508,389 | 4/1985 | Hodges | 299/17 |
| 5,096,002 | 3/1992 | Cherrington | 175/53 |
| 5,269,384 | 12/1993 | Cherrington | 175/53 |

*Primary Examiner*—Hoang C. Dang
*Attorney, Agent, or Firm*—Vinson & Elkins

[57] ABSTRACT

A method and apparatus for removing drilling mud within entrained cuttings is provided using a pump for forcing fluid into a borehole, such that the fluid mixes with cuttings formed during the formation of the hole. The pipe receives the fluid and entrained cuttings at a first end of the pipe and returns the fluid and entrained cuttings to the surface at the second end of the pipe. At the first end of the pipe, air is injected into the drilling fluid with entrained cuttings to form bubbles therein, thereby increasing the velocity of the fluid and entrained cuttings through the pipe. In one alternative embodiment, a suction is provided at one end of the pipe to increase the speed of fluid and entrained cuttings therethrough. In a third embodiment of the present invention, an Archimedes screw is used to remove the fluid and entrained cuttings from the borehole.

7 Claims, 7 Drawing Sheets

METHOD AND APPARATUS FOR CLEANING A BOREHOLE

RELATED APPLICATIONS

This patent application is related to U.S. Pat. No. 5,269,384, entitled "Method and Apparatus for Cleaning a Borehole", issued Dec. 14, 1993 to Cherrington, which is incorporated by reference herein.

TECHNICAL FIELD OF THE INVENTION

This invention relates in general to hole drilling, and more particularly to a device for removing cuttings from the hole.

BACKGROUND OF THE INVENTION

Underground conduits are widely used for the transmission of fluids, such as in pipelines and the like, as well as for carrying wires and cables for the transmission of electrical power and electrical communication signals. While the installation of such conduits is time-consuming and costly for locations where the earth can be excavated from the surface, the routing of such conduits becomes more difficult where such surface excavation cannot be done due to the presence of surface obstacles through which the excavation cannot easily proceed. Such surface obstacles include highways and railroads, where the installation of a crossing conduit would require the shutdown of traffic during the excavation and installation. Such surface obstacles also include rivers, which present extremely difficult problems for installing a crossing conduit, due to their size and the difficulty of excavation thereunder.

Prior methods for the installation of conduits have included the use of directional drilling for the formation of an inverted underground arcuate path extending between two surface locations and under the surface obstacle, with the conduit installed along the drilled path. A conventional and useful method for installing such underground conduits is disclosed in U.S. Pat. No. 4,679,637, issued Jul. 14, 1987, assigned to Cherrington Corporation, and incorporated herein by this reference. This patent discloses a method for forming an enlarged arcuate bore and installing a conduit therein, beginning with the directional drilling of a pilot hole between the surface locations and under a surface obstacle such as a river. Following the drilling of the pilot hole, a reamer is pulled with the pilot drill string from the exit opening toward the entry opening, in order to enlarge the pilot hole to a size which will accept the conduit, or production casing in the case of a pipeline conduit. The conduit may be installed during the reaming operation, by the connection of a swivel behind the reamer and the connection of the conduit to the swivel, so that the conduit is installed as the reaming of the hole is performed. Alternatively, the conduit can be installed in a separate operation, following the reaming of the pilot hole (such reaming referred to as "pre-reaming" of the hole). Additional examples of the reaming operation, both as pre-reaming and in conjunction with the simultaneous installation of the product conduit, are described in U.S. Pat. No. 4,784,230, issued Nov. 15, 1988, assigned to Cherrington Corporation and incorporated by this reference.

While the above-described methods are generally successful in the installation of such conduit, certain problems have been observed, especially where certain types of sub-surface formations are encountered. Referring now to FIGS. 1 and 2, examples of such problems in the installation of conduit in an underground arcuate path will now be described.

FIG. 1 illustrates the reaming operation described above, in conjunction with the installation of production conduit as the reamer is pulled back. In the example of FIG. 1, entry opening 0 is at surface S on one side of river R; exit opening E is on the other side of river R from entry opening 0. At the point in the installation process illustrated in FIG. 1, a drilling apparatus, including a hydraulic motor 14 mounted on a carriage 16 which is in place on an inclined ramp 12, has drilled the pilot bore hole B from entry 0 to exit E, using drill string 10, and the reaming and installation is in progress. Motor 14 is now pulling reamer 48, to which production conduit 46 is mounted, back from exit E toward entry 0. Reamer 48 is larger in diameter than the diameter of production conduit 46. Upon completion of the reaming operation of FIG. 1, if successful, production conduit 46 will be in place under river R, and extending between exit E and entry 0.

Referring now to FIG. 2, a close-up view of the location of reamer 48 and production conduit 46 in FIG. 1 is now illustrated. Leading drill string section 10C is attached by way of tool joint 52 to reamer 48, reamer 48 having cutting teeth at its face. Swivel 50 connects production conduit 46 to reamer 48, by way of extension 62 connected to a sleeve 66 on conduit 46. As is evident from FIGS. 1 and 2, bore hole B is enlarged to enlarged opening D by operation of reamer 48. Conventional sizes of conduit 46 are on the order of 20 to 48 inches in outside diameter, with the size of reamer 48 greater in diameter than conduit 46. Due to reamer 48 being larger than conduit 46, an annulus 68 surrounds conduit 46 as it is pulled into the hole D. Provision of the annulus 68 allows for reduced friction as the conduit 46 is placed therein.

As noted above, prior techniques have also included a pre-reaming step, wherein a reamer, such as reamer 48, is pulled back from exit E to entry 0 without also pulling production conduit 46 into the reamed hole. In such a pre-reaming step, a following pipe generally trails reamer 48 in such the same manner as conduit 46 trails reamer 48 in FIGS. 1 and 2, to provide a string for later installation of conduit 46. Such a trailing pipe will be of a much smaller size than conduit 46 of FIGS. 1 and 2, for example on the order of five to ten inches in diameter.

It has been observed in the field that both the pre-reaming and reaming with installation operations are subject to conduit or pipe sticking problems, especially as the size of the production conduit increases in diameter, and as the length of the path from entry 0 to exit E increases. Such sticking is believed to be due, in large degree, to the inability to remove cuttings resulting from the reaming operation. Due to the large volume of earth which is cut by way of the reaming operation, and the generally low fluid flow velocity of drilling or lubricating mud or fluid into the reaming location, the velocity of cuttings circulating from the reaming location is minimal. While the mud or other lubricating fluid flow could be increased in order to increase the velocity of the cuttings from the reaming location, such an increase in the velocity of the fluid could result in such undesired results as hole wall erosion and fracturing through the formation.

Due to the inability to sufficiently remove the cuttings during the reaming operation, it is believed that the cuttings pack together near the location of the reamer. Many of the cuttings from the reaming operation are heavier than the fluid transporting them and, in such large diameter holes as are required for the installation of conduit, these large cuttings will fall out or settle toward the bottom of the hole first, and then build up into a circumferential packed mass, causing a poor rate of reaming. Referring to FIG. 2, where a production conduit 46 is being pulled through with reamer 48, it is believed that such packing will begin at locations P surrounding the leading end of conduit 46, and also along the sides of conduit 46 in annulus 68. As the cuttings pack together, squeezing whatever water or fluid is present therein, the density of the packed mass increases. Upon sufficient packing, it is believed that pressure builds up ahead of locations P, toward the bit of reamer 48, such pressure resulting from the mud or fluid continuing to be pumped into the reaming location with the return flow reduced at locations P around conduit 46 in annulus 68. It is also believed that this buildup of pressure will also force cuttings into bore hole B ahead of reamer 48, and that these cuttings will also begin to pack, most likely at locations P' near the first tool joint 70 ahead of reamer 48.

The buildup of pressure between locations P and P' surrounding reamer 48 causes significant problems in the reaming operation. Such effects have been observed in the field during reaming operations, when the reamer cannot be rotated, pulled or pushed at a particular location in the operation. It should be noted that the sticking of the reamer occurs both for the pre-reaming operation described hereinabove and for the combined reaming and pulling operation. It should further be noted that the pressure buildup described hereinabove is believed to be worse in high pressure formations such as clay.

Another undesired effect resulting from the buildup of pressure when the reamer cuttings are insufficiently removed is similar in nature to differential sticking in the downhole drilling field. As is well known in the downhole drilling art, differential sticking of the drill string occurs when the pressure of the drilling mud surrounding the drill string is greater than the pressure exerted by the surrounding formation. In the event that the caking of drilling mud and the structure of the well bore is not strong enough to maintain its shape when presented with such a differential pressure, the pressure of the drilling mud can force the drill string into the formation, holding it there with sufficient pressure that it cannot be released from the surface.

It is now believed that similar effects can be present in the field of installation of underground conduit, due to insufficient removal of the reaming cuttings. If the pressure near reamer 48, when packed off as described hereinabove, is sufficiently greater than the pressure exerted by a surrounding formation, the conduit 46 can be driven into the formation, causing sticking of the conduit 46 thereat. It should be noted that the installation of underground conduit is particularly susceptible to such sticking, since much of the formations underlying rivers are sedimentary or alluvial formations, with relatively thin layers of differing strength. Accordingly, the drilling and reaming operations in river crossing installations are exposed to many differing formations along the length of the path, with the likelihood of encountering a weak (in pressure) formation being relatively large. Accordingly, such pressure buildup due to insufficient reaming cutting removal can cause conduit sticking at particular locations along the underground path.

Furthermore, it should be noted that the insufficient removal of cuttings impacts the reaming operation itself. If cuttings are not sufficiently removed from the reaming location, a number of cuttings will tend to be present in front of reamer 48 of FIG. 2; as a result, reamer 48 will tend to recut its own cuttings, rather than cutting the earth in its path and enlarging the hole. This results in poor penetration rates for the reaming operation. As noted above, as the reaming rate slows, the pressure buildup between the packed locations will accelerate, further degrading the operation and increasing the likelihood of the reamer and conduit sticking.

In addition, the recutting of the cuttings results in a high degree of reamer wear, both at the teeth and also in the parent metal of reamer 48. In rotor reamers, such wear has been observed also at the seals and bearings. This has also been observed for reamers which use carbide-coated rotating cones as the cutting bits, in similar manner as a downhole tri-cone bit; while the carbide wears slowly, the insufficient removal of the cuttings has been evidence in significant wear of the parent metal of the reamer. Furthermore, as the cuttings become smaller due to multiple recutting cycles, the cuttings which are removed with the drilling mud are much more difficult to process by the solids control system.

Other methods for installing conduit in an underground path includes forward thrust techniques, such as described in U.S. Pat. Nos. 4,176,985, 4,221,503 and 4,121,673. Particularly, U.S. Pat. No. 4,176,985 discloses an apparatus which thrusts a casing into a pilot hole, with a bit leading the casing. However, while such forward thrust techniques are useful for unidirectional application such as the introduction of conduits into the ocean, such methods place significant stress on the conduit itself, and also present relatively slow installation rates. The pull-back methods described hereinabove and hereinbelow are preferable from the standpoint of reduced stress on the casing, as well as increased installation rates.

A method and apparatus for removing cuttings is described in U.S. Pat. No. 5,096,002 to Cherrington, issued Mar. 17, 1992, entitled "Method and Apparatus for Enlarging an Underground Path" which is incorporated by reference herein. While the device described in U.S. Pat. No. 5,096,002 is effective in removing the cuttings, it relies on several moving parts, which may decrease its reliability.

Therefore, a need has arisen in the industry for a method and apparatus for removing cuttings from a bore hole with a reduced number of working parts.

SUMMARY OF THE INVENTION

In accordance with the present invention, a method and apparatus for removing drilling mud with entrained cuttings is provided which substantially prevents disadvantages associated with the prior art.

In the present invention, a pump is provided for forcing a fluid into a borehole, such that the fluid mixes with the cuttings from the hole. A pipe receives the fluid and entrained cuttings at a first end of the pipe and returns the fluid and entrained cuttings to the surface at the second end of the pipe. At the first end of the pipe, air is injected into the drilling fluid with entrained cuttings to form bubbles therein, thereby increasing the velocity of the fluid and entrained cuttings through the pipe.

In a second embodiment of the invention, a suction is provided at one end of the pipe to increase the speed of the fluid and entrained cuttings therethrough.

In a third embodiment of the present invention, an Archimedes screw is used to remove the fluid and entrained cuttings from the borehole.

The present invention provides significant advantages over the prior art. The air may be injected into the drilling mud (or other drilling fluid) without significantly increasing cost or complexity of the drilling operations. The injected air forms bubbles which significantly increase the flow of the drilling mud to the surface.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
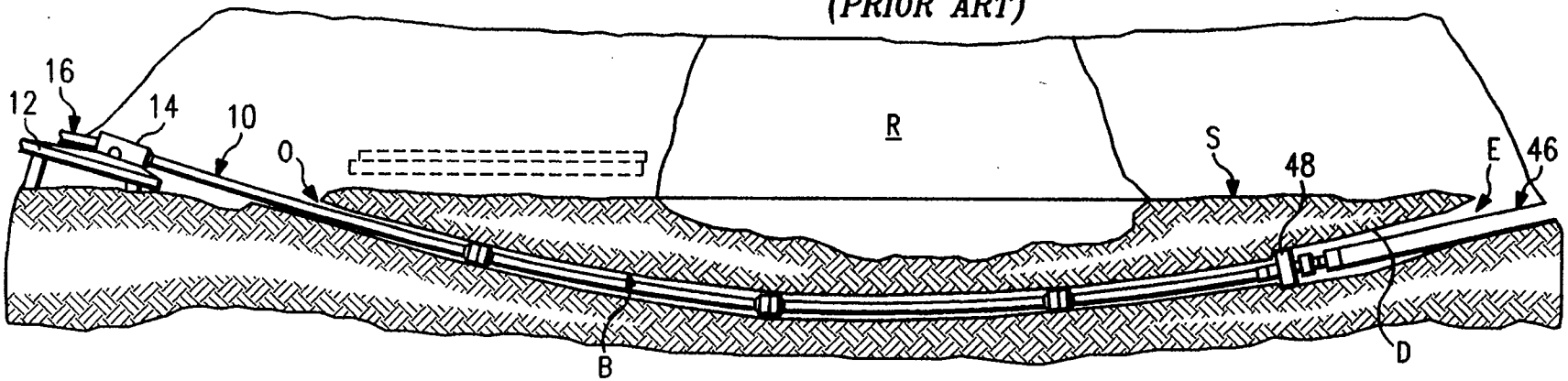
FIG. 1 (PRIOR ART)
FIGS. 1 and 2 are cross-sectional drawings showing an apparatus for reaming and installing a conduit according to the prior art.
Figure 2:
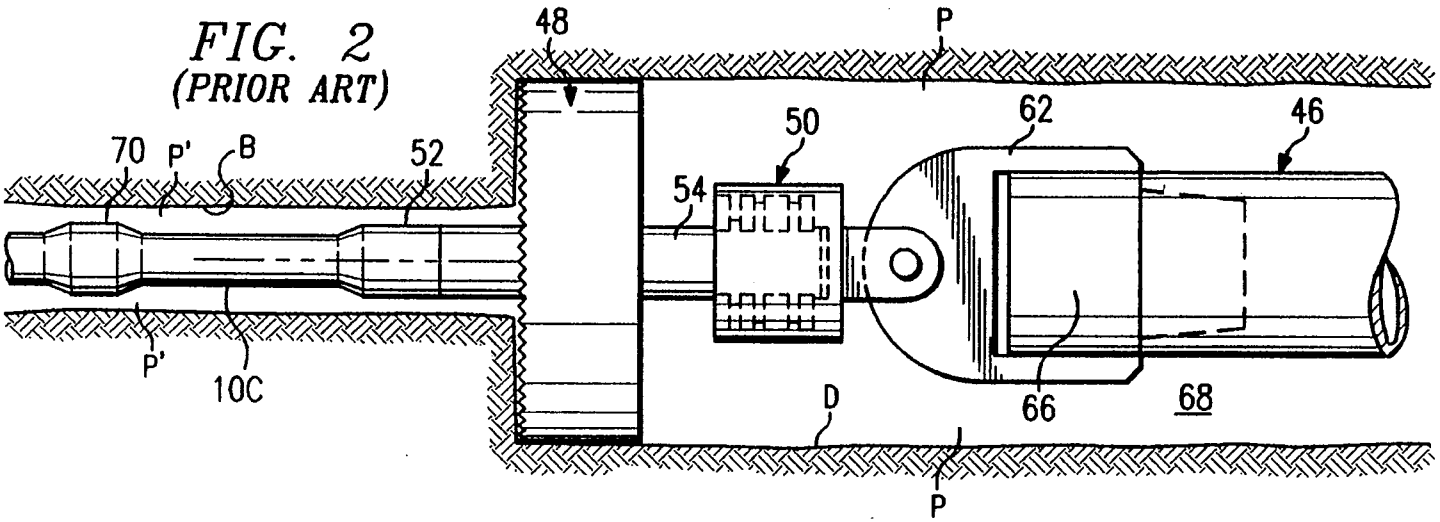
FIG. 2 (PRIOR ART)

The preferred embodiment of the present invention and its advantages are best understood by referring to FIGS. 3–7 of the drawings, like numerals being used for like and corresponding parts of the various drawings.

FIG. 3 illustrates a side view of a first embodiment of a device for creating a borehole and removing cuttings therefrom. A pilot borehole 100 is drilled underneath a river 102 or other surface obstacle. A working drill string 104 and a trailing drill string 106 are coupled to the hole opener (or "reamer") 108. As the hole opener is pulled through the pilot hole 100, an enlarged borehole 110 is formed. A stationary casing 112 is positioned within the enlarged borehole 110. A diffuser 114 is connected to the stationary casing 112 and to an air compressor 116 via air pipe 118. The stationary casing 112 terminates in a stuffing box 120 (also known as a "packing gland") through which the trailing drill string 106 is disposed. The stuffing box 120 is coupled to a discharge line 122 which expels the drilling fluid and entrained cuttings into a solids control device 124 for purifying the drilling mud. The drilling mud output from the solids control device 124 is pumped into the trailing drill string 106 via high pressure mud line 126 and pressure mud swivel 127 and is also pumped into the enlarged borehole 110 via mud pump discharge line 128 using mud pump 130. Drill rig 132 is coupled to the working drill string 104.

Briefly, the operation of the reamer/hole cleaning device is as follows. After forming the pilot hole 100, the hole enlarger 108 is rotated by drill rig 132 to form enlarged borehole 110. During rotation of the hole opener 108, drilling mud, or other drilling fluid, is forced through trailing drill string 106 to emerge at the face of hole opener 108 carry the cuttings away from the hole opener 108 during reaming operations. As the hole opener 108 forms the enlarged hole, cuttings 134 are formed which mix with the drilling mud in the enlarged hole. Drilling mud is also fed directly into the enlarged hole through mud pump discharge line 128. The drilling mud and entrained cuttings return via the path formed between the stationary casing 112 and the trailing drill string 106 and are transported via discharge line 122 to the solids control device 124 which removes solids from the drilling mud and returns the recycled drilling mud to the enlarged borehole 110.

Importantly, the air compressor 116 forces air into the stationary casing 112 via diffuser 114 which causes air bubbles to be mixed with the drilling fluid and entrained cuttings. As the mixture of drilling mud and cuttings 134 enter the stationary casing 112, the air bubbles expand creating a higher velocity of mud through the stationary casing. It is believed the air bubbles lower the pressure of the mud within the stationary casing, thereby increasing the velocity of the mud.

Figure 3A:
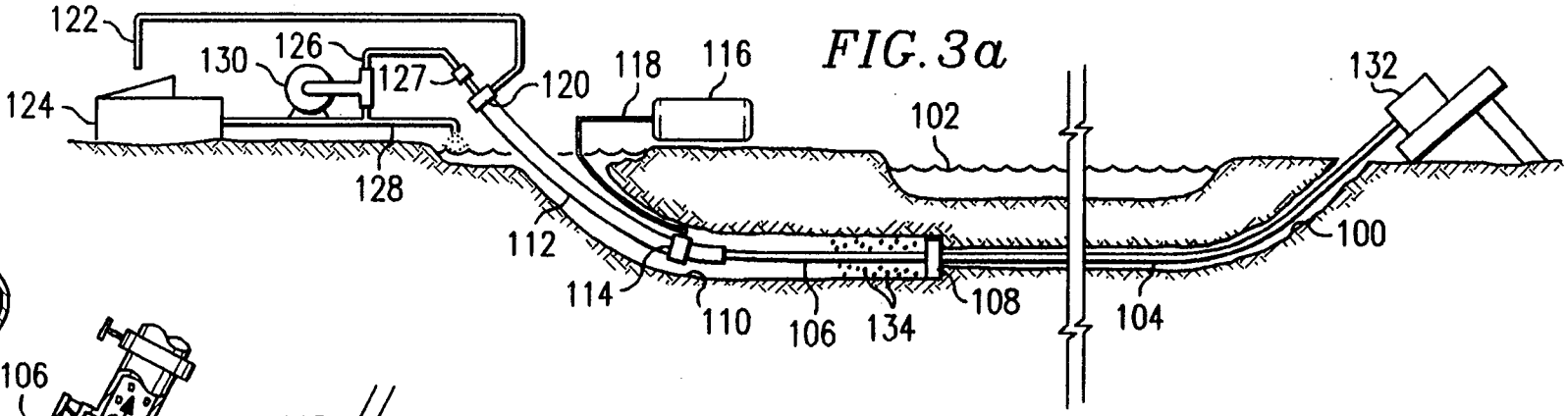
FIGS. 3*a*–3*b* are side views of a device for drilling a borehole with a stationary casing and removing cuttings therefrom using air bubbles to enhance removal of the cuttings.
Figure 3B:
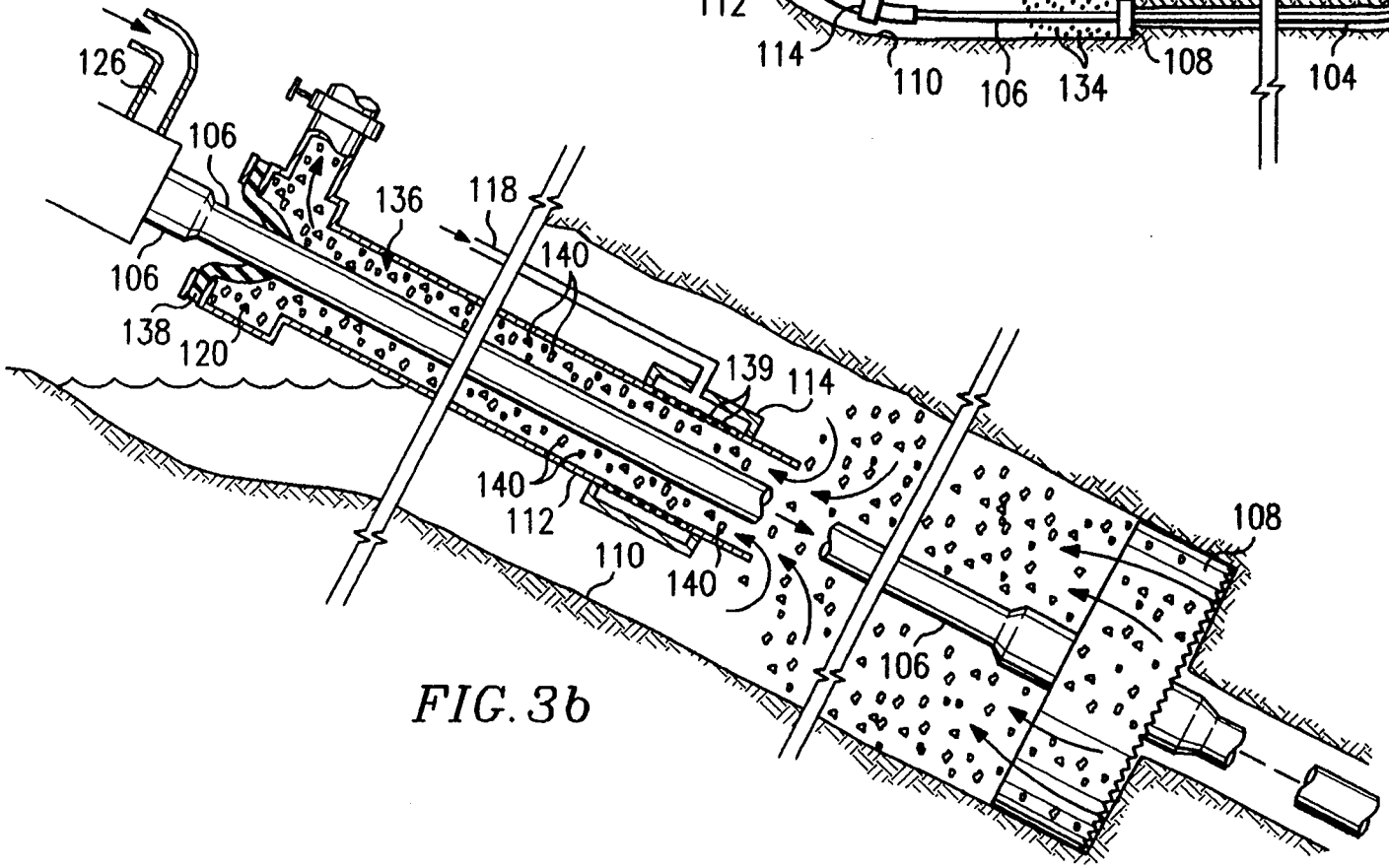

The flow of mud through the stationary casing is shown in greater detail in connection with FIG. 3*b*. As shown in FIG. 3*a*, trailing drill string 106 is disposed within stationary casing 112, forming a channel 136 through which the drilling mud and cuttings may be transported to the surface. The trailing drill string 106 is coupled to reamer 108 such that drilling mud transported through the trailing drill string 106 is output from the reamer 108 for lubrication during reaming operations. Stuffing box 120 includes a seal 138 for allowing rotation of the trailing drill string 106 while preventing the returning drilling mud/cuttings from exiting at the point of rotation.

Diffuser 114 is disposed circumferentially about the stationary casing 112. The diffuser 114 receives compressed air via air pipe 118. The air is forced into the channel 136 through perforations 139 where bubbles 140 are formed in the drilling mud. The bubbles 140 increase the velocity of the drilling mud/cuttings through the channel 136.

Figure 4A:
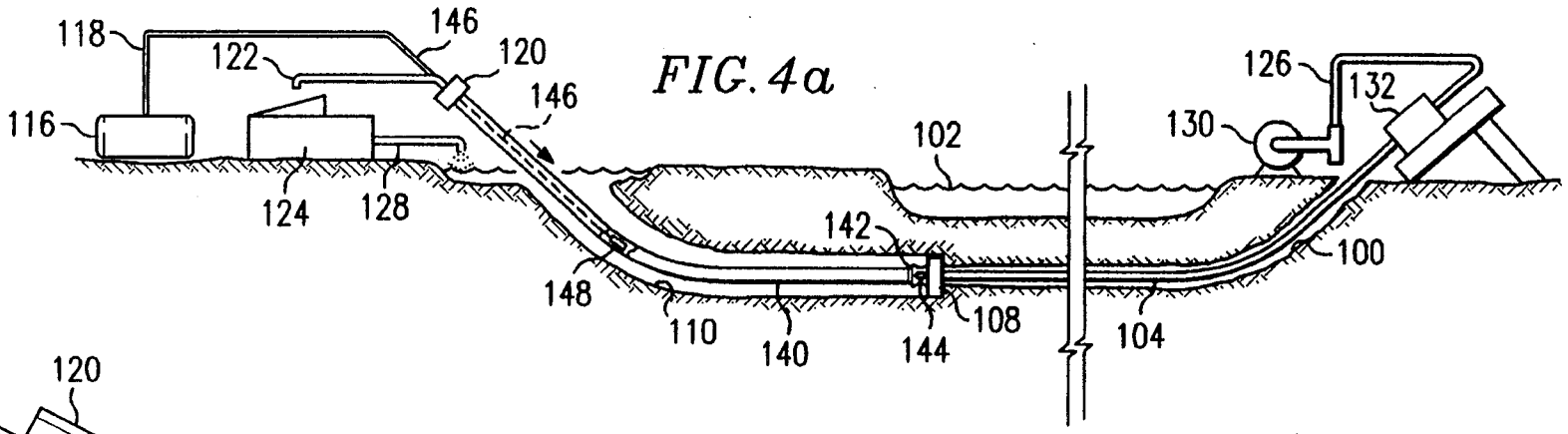
FIGS. 4*a*–4*b* illustrate side views of a device for drilling a borehole with a rotating casing and removing cuttings therefrom using air bubbles to enhance removal of the cuttings.
Figure 4B:
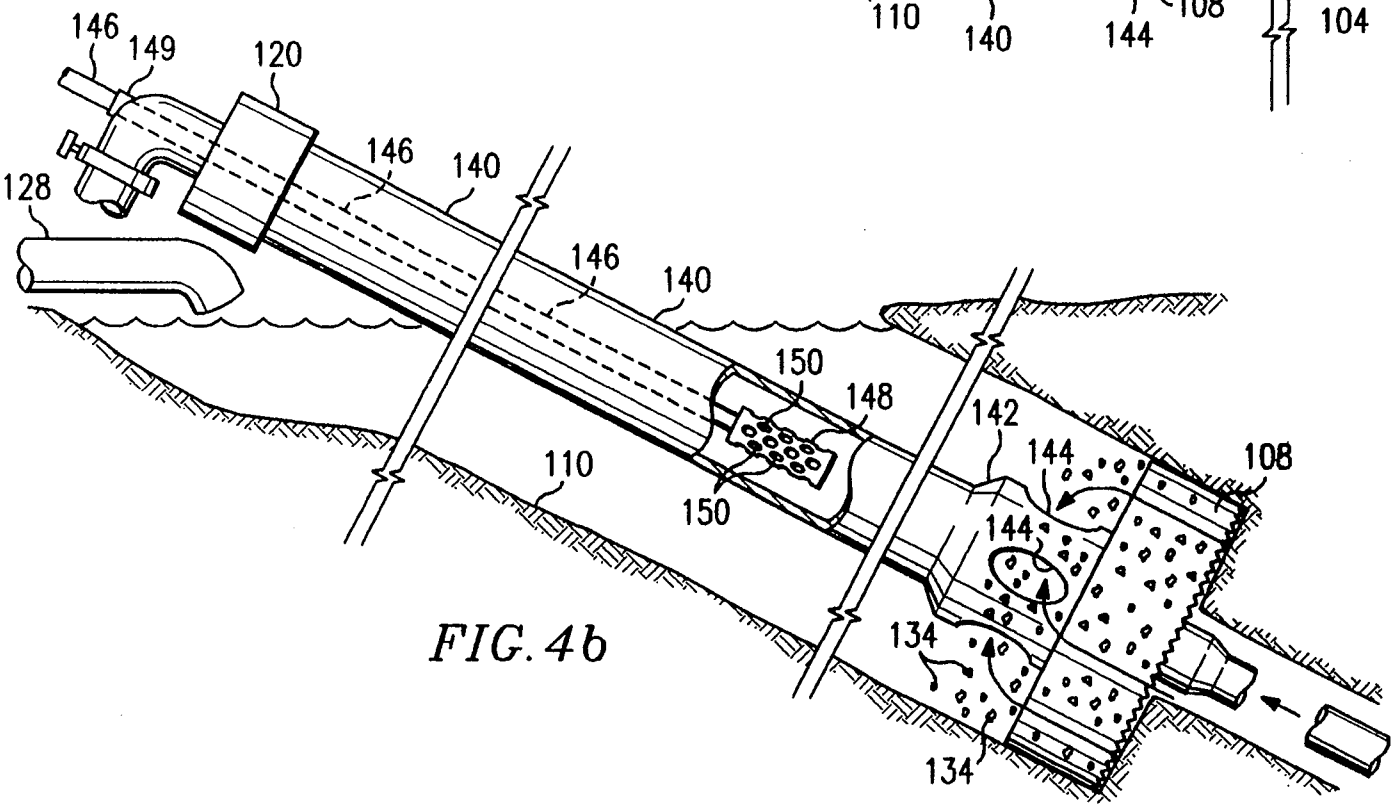

FIGS. 4*a*–*b* illustrate a second embodiment wherein air bubbles are used to increase the velocity of the drilling mud/cuttings. In this embodiment, a rotating or non-rotating trailing drill casing 140 is coupled to hole opener 108. The trailing casing 140 includes an intake sub 142 having holes 144. Air compressor 116 is coupled to a stationary air pipe 146 which terminates within the trailing casing 140 at diffuser head 148. Stationary air pipe 146 is coupled to trailing casing 140 through air pipe packing gland 149. Diffuser head 148 includes a plurality of perforations 150 through which the compressed air from air compressor 116 may flow. Mud pump 130 is coupled to working drill string 104 through drill rig 132. If a non-rotating trailing drill casing 140 is used, a swivel joint should be provided so that the working drill 104 does not need to turn the trailing drill casing. For illustration, it will be assumed herein that trailing drill casing is a rotating casing.

In operation, drilling mud is provided to the hole opener 108 through the working drill string 104. Drilling mud is also forced into the enlarged hole by solids control device 124. The mud combines with cuttings from the reaming operation, which enter rotating casing 140 through the holes 144 in intake sub 142. Stationary air pipe 146 receives compressed air from air compressor 116, and outputs the compressed air through the perforations 150 of diffuser head 148. As described above, the air forms bubbles in the combination drilling mud/cuttings and increases its velocity to the surface in the rotating trailing casing 140. The aerated drilling mud/cutting mixture emerges from the rotating trailing casing 140 through discharge line 122 to the solids control device 124.

This embodiment of the invention provides the advantage of drawing the drilling mud/cuttings mixture into the rotating trailing casing 140 at the point of reaming. Hence, the cuttings can be drawn into the rotating trailing casing 140 before they have a chance to settle at the bottom of the enlarged hole. In order to increase the draw into the intake sub 142, a jet pump may be used wherein a high velocity stream of drilling mud is generated approximate the intake sub to create a pressure differential which draws the drilling mud/cuttings into the trailing casing 140. Jet pumps are discussed in greater detail in connection with U.S. Pat. No. 5,269,384, filed Nov. 8, 1991, entitled "Method and Apparatus for Cleaning a Borehole" to Cherrington, which is incorporated by reference herein.

Figure 4C:
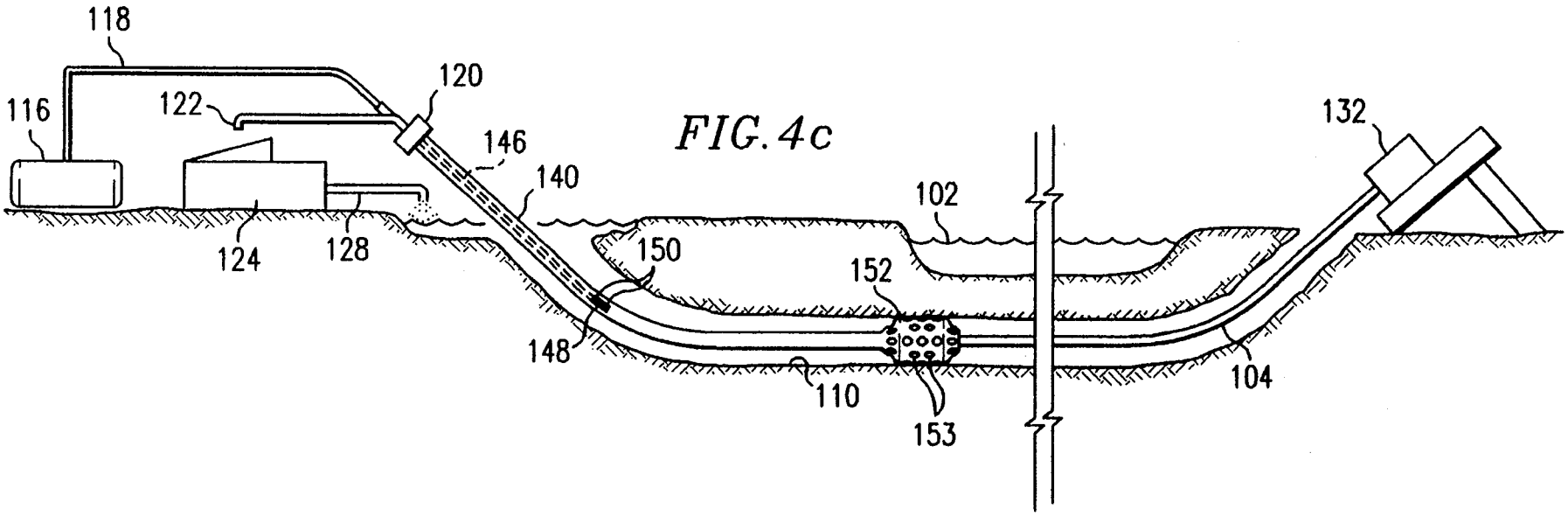
FIG. 4*c* illustrates a device for removing cuttings from an existing borehole using air bubbles to enhance the removal of the cuttings.

FIG. 4*c* illustrates an embodiment of the invention used to remove cuttings from an enlarged hole after the reaming apparatus has been removed. This embodiment is similar to the embodiment shown in FIGS. 4*a–b*, except head 152 is rotated within the enlarged hole to receive the mud/cuttings from the enlarged hole through holes 153. As described above, suction into the head 152 may be generated by a jet pump, as described in U.S. Pat. No. 5,269,384, referenced above.

Figure 5A:
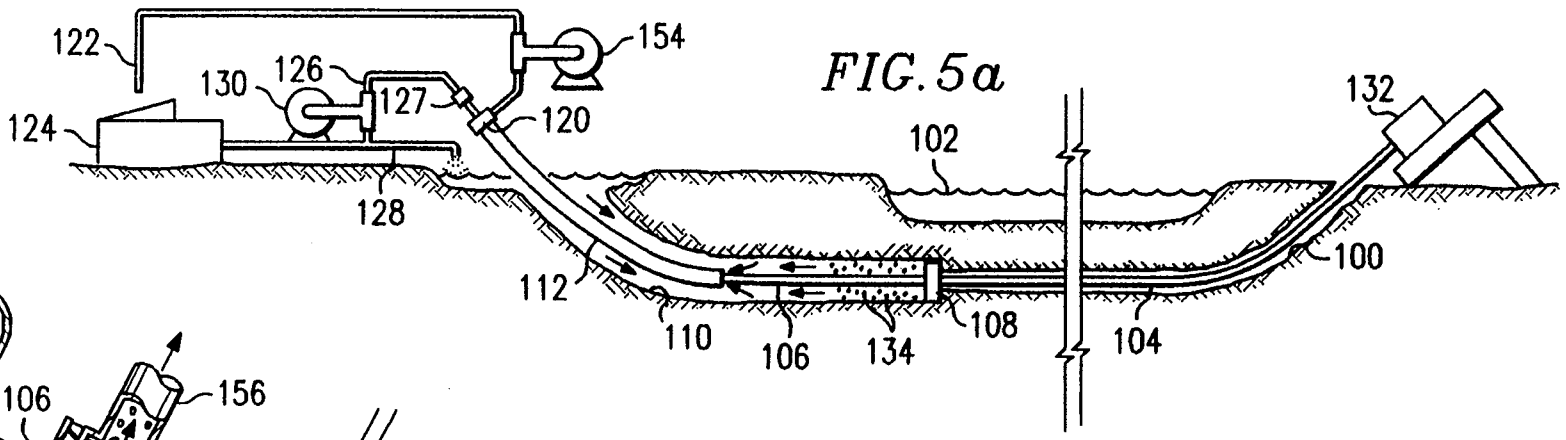
FIGS. 5*a*–5*b* illustrate side views of a device for creating a borehole with a stationary casing and removing cuttings therefrom using suction to enhance removal of the cuttings.
Figure 5B:
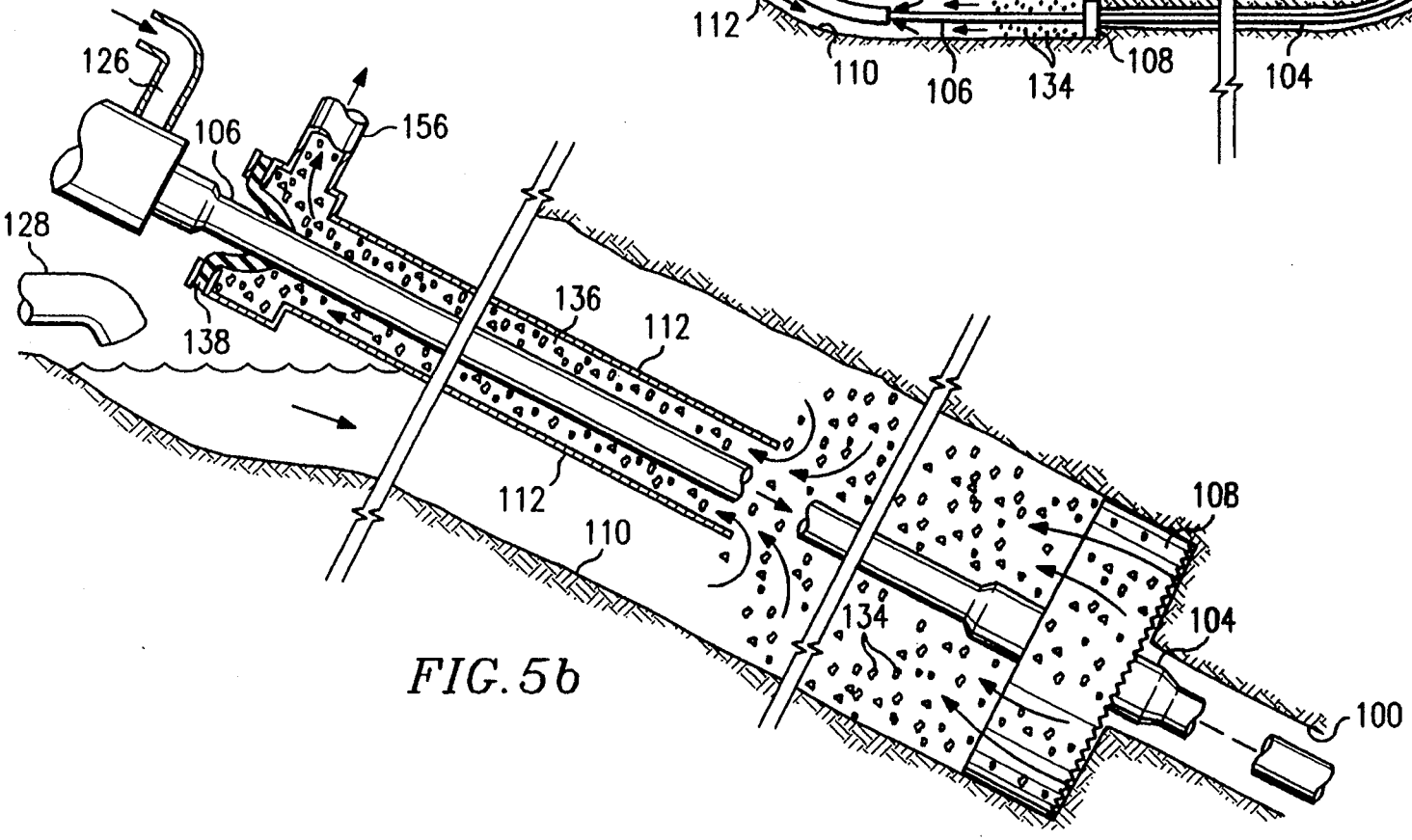

FIGS. 5*a–b* illustrate an embodiment similar to the device shown in FIGS. 3*a–b*, with the exception that suction is used to increase the flow of the drilling mud/cuttings through the stationary casing 112. In this embodiment, a vacuum pump 154 is coupled to the discharge line 156 which conveys the drilling mud/cuttings from the stationary casing 112. The vacuum pump 154 creates a suction which pulls the drilling mud/cuttings through the stationary casing and outputs the drilling mud/cuttings to the solids control device 124 via the discharge line 122.

The operation of the device shown in FIGS. 5*a–b* is similar to the device shown in FIGS. 3*a–b*. Drilling mud is output to the enlarged hole 110 via the mud pump discharge line 28 and to the hole enlarger 108 via the trailing drill string 106. As the reaming operations are performed under power of the drill rig 132 and working drill string 104, cuttings become mixed with the drilling fluid and are drawn into the stationary casing 112 by the suction pump 154.

To further increase the flow of the drilling mud/cuttings through the stationary casing, the compressed air method shown in FIG. 3*a* could be combined with the suction method shown in FIG. 5*a*.

Figure 6A:
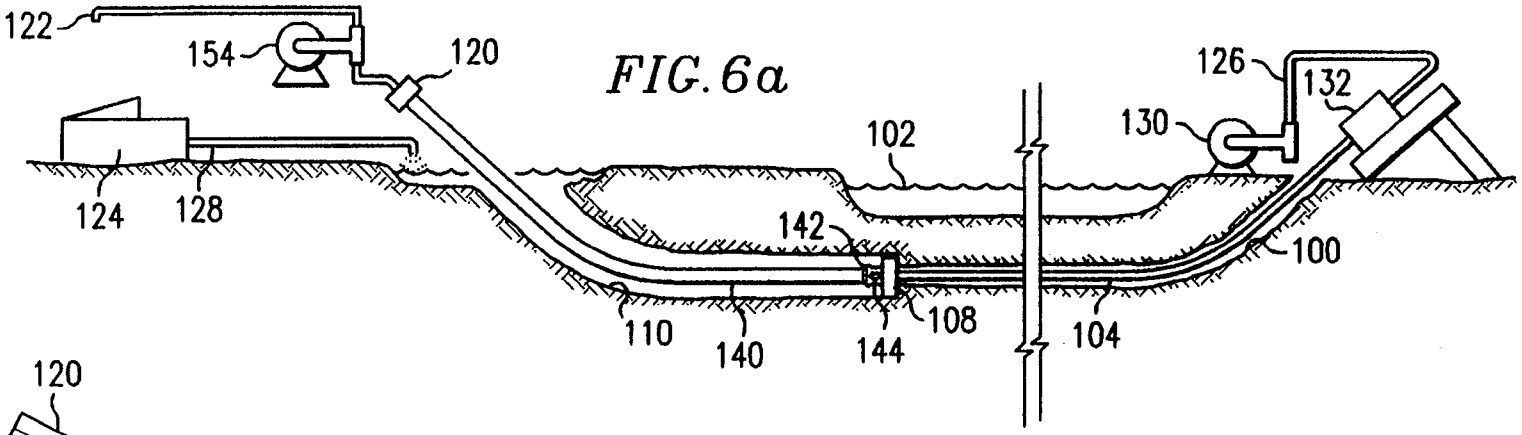
FIGS. 6*a*–6*b* illustrate side views of a device for creating a borehole with a rotating casing and removing cuttings therefrom using suction to enhance removal of the cuttings.
Figure 6B:
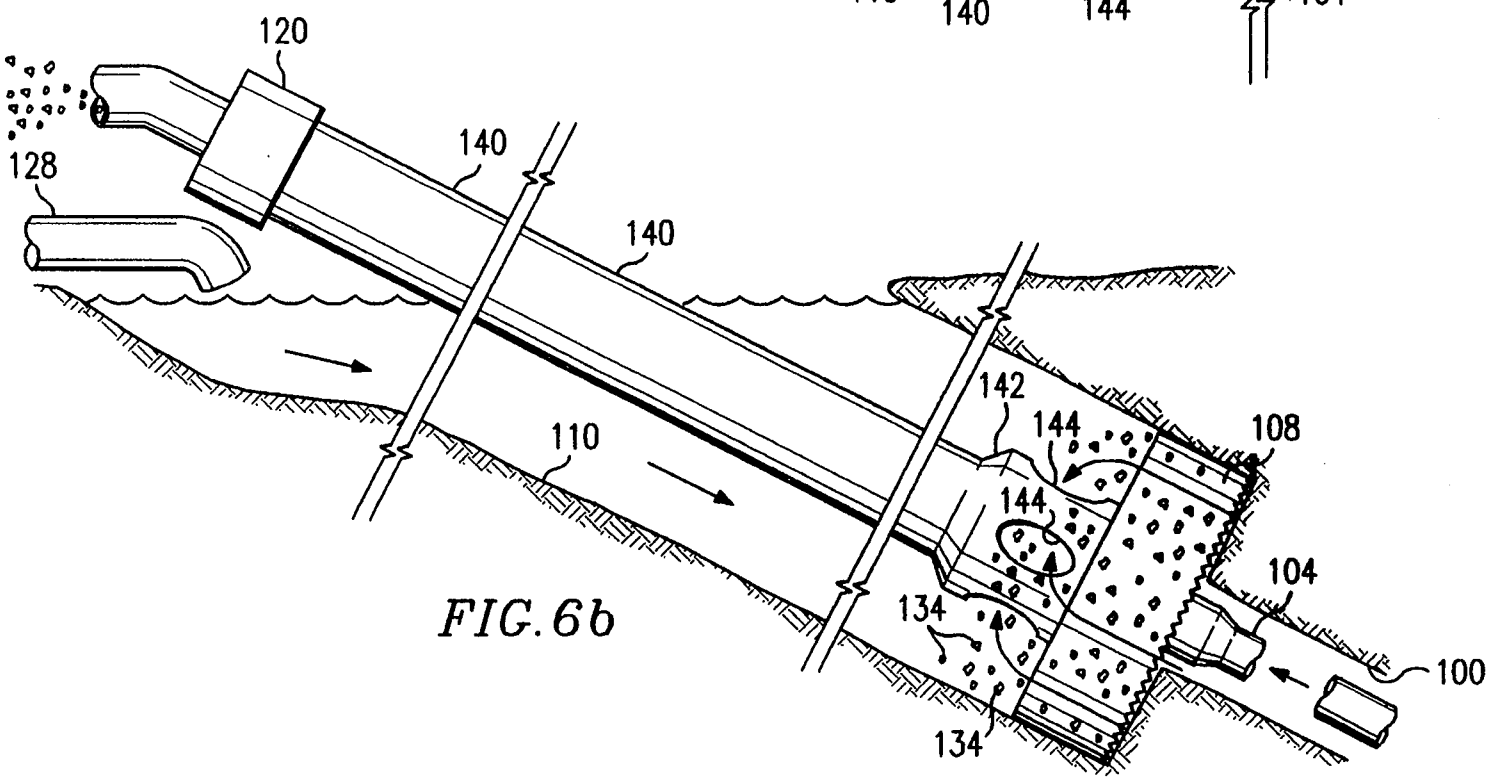

FIGS. 6*a–b* illustrate a second embodiment of a reaming/cleaner which uses suction through a rotating (or non-rotating) trailing casing, similar to the device shown in connection with FIGS. 4*a–b*. This embodiment is structurally similar to the structure shown in FIGS. 4*a–b*, except that a vacuum pump 154 is coupled to the rotating casing 140 in order to draw the drilling mud/cuttings from the rotating casing. While the air compressor 116 of FIG. 4*a* is not used in the illustrated embodiment of FIGS. 6*a–b*, however, both the air compressor 116 and the vacuum pump 154 may be used in conjunction to increase the flow of the drilling mud/cuttings through the rotating trailing casing 140.

In operation, drilling mud is provided through the working drill string 104 to the hole opener 108. Additionally, drilling mud is provided by the solids control unit 124 to the enlarged borehole 110. During the reaming operation, cuttings become mixed with the drilling mud and are drawn into the rotating casing 140 through holes 144 of intake sub 142. The drilling mud/cuttings are removed by the vacuum pump 154 to the solids control unit 124 via discharge line 122.

As previously described in connection with FIG. 4*c*, the device shown in FIGS. 6*a–b* can be designed as a hole cleaner (without the reamer) to remove cuttings from an already enlarged borehole.

Figure 7A:
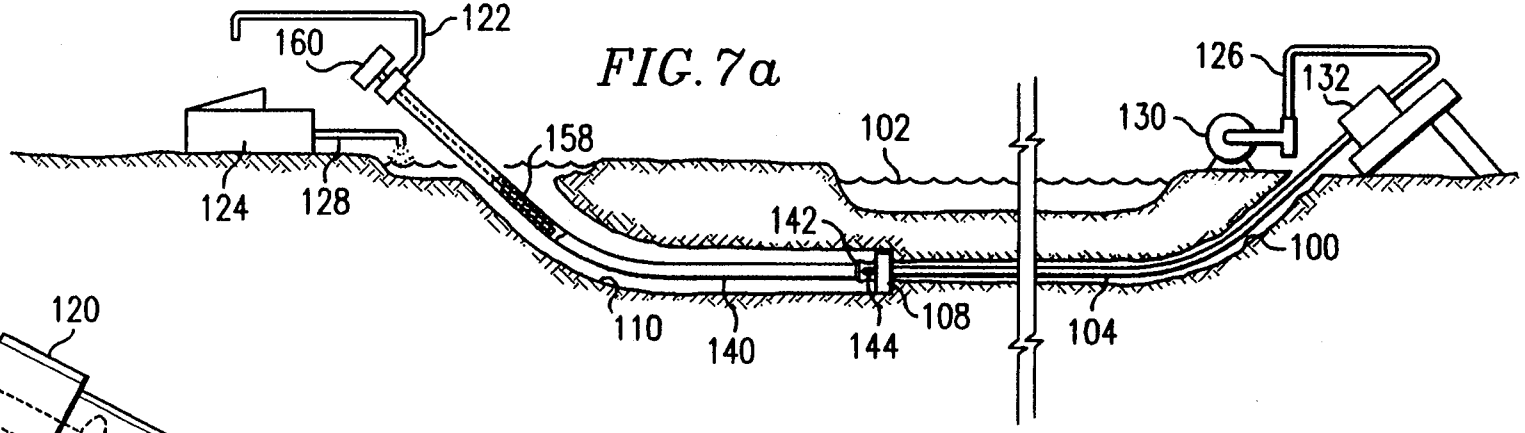
FIGS. 7*a*–7*b* illustrate side views of a device for creating a borehole and removing cuttings therefrom using an Archimedes screw.
Figure 7B:
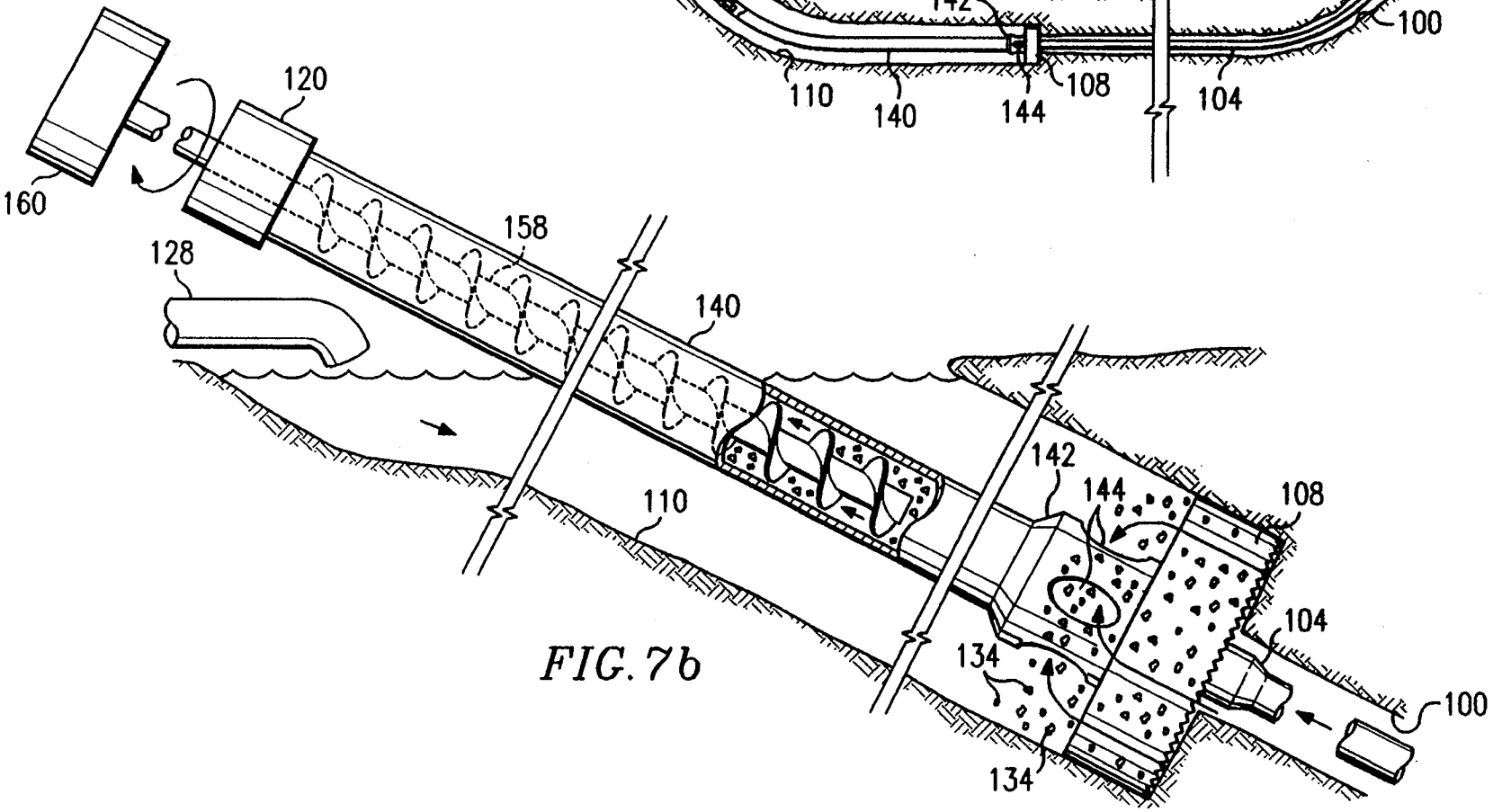

FIGS. 7*a–b* illustrate another embodiment of a reamer/hole cleaner which uses positive displacement to create a suction to remove the drilling mud/cuttings from the enlarged borehole. A structure shown in FIGS. 7*a–b* is similar to that shown in FIG. 6*a*, except an Archimedes screw 158 is used to remove mud/cuttings from the rotating (or non-rotating) casing 140. The Archimedes's screw is disposed within rotating casing 140 and powered by rotary drive 160. As cuttings are transported up the Archimedes's screw 158, a suction results which draws more drilling mud/cuttings into the holes 144 of intake sub 142.

This embodiment has the advantage that the flow of drilling mud/cuttings through the rotating casing 140 is very controllable.

Although the present invention and its advantages have been described in detail, it should be understood that various changes, substitutions and alterations can be made herein without departing from the spirit and scope of the invention as defined by the appended claims.

What is claimed is:

1. Apparatus for removing cuttings from a hole having first and second openings comprising:

a pump for forcing a fluid into the hole at the first opening, said fluid mixing with the cuttings from the hole;

a drill string coupled to said pump a rotatable pipe disposed through said second opening for receiving the fluid and entrained cuttings at a first end and returning the fluid and entrained cuttings to the surface at a second end; and apparatus for injecting air into the fluid with entrained cuttings to form bubbles therein comprising:

an air compressor; and a inner pipe disposed within said pipe for receiving fluid, said inner pipe having a first end coupled to said air compressor and a second end disposed proximate said first end of said pipe for receiving fluid, for injecting said compressed air into the fluid with entrained cuttings.

2. The apparatus of claim 1 wherein said apparatus for injecting air further comprises an end portion having a plurality of holes formed therein coupled to said second end of said inner pipe.

3. The apparatus of claim 2 and further comprising a reamer coupled to said pipe for receiving fluid, said reamer having holes formed therein to receive the fluid with entrained cuttings.

4. The apparatus of claim 1 wherein said inner pipe remains stationary relative to the rotatable pipe.

5. The apparatus of claim 1 and further comprising a device for forming a suction to draw said fluid and entrained cuttings from the rotatable pipe.

6. A method for removing cuttings from a hole having first and second openings comprising the steps of:

forcing a fluid into the hole at said first opening through a drill string, said fluid mixing with cutting disposed in said hole;

receiving the fluid and cuttings mixture in a rotatable pipe disposed in said hole through the second opening;

injecting air through an inner pipe disposed within the rotatable pipe to form bubbles with the mixture of fluid and cuttings.

7. The method of claim 6 and further comprising the step of forming an enlarged borehole simultaneous with said receiving step.

* * * * *